US009003586B2

(12) United States Patent
Weddle

(10) Patent No.: US 9,003,586 B2
(45) Date of Patent: Apr. 14, 2015

(54) WHACKER TOOL

(71) Applicant: David R. Weddle, Bunker Hill, WV (US)

(72) Inventor: David R. Weddle, Bunker Hill, WV (US)

( * ) Notice: Subject to any disclaimer, the term of this patent is extended or adjusted under 35 U.S.C. 154(b) by 214 days.

(21) Appl. No.: 13/887,545

(22) Filed: May 6, 2013

(65) Prior Publication Data

US 2014/0325765 A1 Nov. 6, 2014

(51) Int. Cl.
*A62B 3/00* (2006.01)
*B25F 1/00* (2006.01)

(52) U.S. Cl.
CPC .. *A62B 3/005* (2013.01); *B25F 1/00* (2013.01)

(58) Field of Classification Search
CPC ..... A62B 3/005; B66F 19/00; B25D 1/00; B25D 1/16; B25F 1/00; B25F 1/006
USPC ..... 81/27; 7/166; 254/104, 131, 21
See application file for complete search history.

(56) References Cited

U.S. PATENT DOCUMENTS

| | | | | |
|---|---|---|---|---|
| 103,330 | A | 5/1870 | Heusser | |
| 344,653 | A * | 6/1886 | Harmon | 7/166 |
| 585,123 | A | 6/1897 | Severance | |
| 840,580 | A | 1/1907 | McMillan | |
| 1,110,969 | A * | 9/1914 | Stacy | 7/145 |
| 3,219,316 | A * | 11/1965 | Fried | 254/131 |
| 3,623,173 | A * | 11/1971 | Hagqvist | 7/145 |
| 3,710,407 | A * | 1/1973 | Reid | 7/144 |
| 5,070,564 | A * | 12/1991 | Fey | 7/170 |
| 5,088,174 | A * | 2/1992 | Hull et al. | 29/254 |
| 5,109,739 | A * | 5/1992 | Hull et al. | 81/463 |
| 5,167,043 | A | 12/1992 | Lopez et al. | |
| 5,428,853 | A | 7/1995 | Menke et al. | |
| 6,308,934 | B1 | 10/2001 | Gallo | |
| 6,474,198 | B2 * | 11/2002 | Lowther | 81/27 |
| 6,928,682 | B1 * | 8/2005 | Hahn | 7/106 |
| 7,634,830 | B2 | 12/2009 | Ryan | |
| 7,735,172 | B2 | 6/2010 | Newton et al. | |
| 8,100,035 | B1 * | 1/2012 | Smith | 81/20 |
| 8,695,458 | B2 * | 4/2014 | Jensen et al. | 81/27 |
| 2011/0113566 | A1 | 5/2011 | Holbrook | |
| 2012/0228568 | A1 | 9/2012 | Leon | |
| 2013/0213583 | A1 * | 8/2013 | Jensen et al. | 157/5 |

* cited by examiner

*Primary Examiner* — David B Thomas
(74) *Attorney, Agent, or Firm* — Capitol City TechLaw

(57) ABSTRACT

A whacker tool may include a bar having one end with a wedge head and another end with a spoon head. The wedge head may include a V-shaped notch that bifurcates the wedge head into two legs. The spoon head may include a convex working surface and a concave working surface that face away from each other. A J-hook can be provided on the bar and the base of the spoon head. A pair of stops may be provided at spaced apart locations on the bar and located between the wedge head and the J-hook. A slide hammer can be mounted on the bar for movement between the stops. The slide hammer can be pounded against the stops stop to provide impact drive forces on the wedge head and the spoon head, and impact pulling forces on the J-hook.

16 Claims, 6 Drawing Sheets

WHACKER TOOL

BACKGROUND

1. Field

Example embodiments relate in general to tools for use by public safety and military personnel, and more specifically, to such tools that may be used to breach doors and/or remove drywall and plaster from walls and ceilings.

2. Discussion of Related Art

Numerous and varied tools for breaching doors and/or removing drywall and plaster are well known. The tools are typically designed to meet the specific needs of public safety and military personnel inside a building or at the scene of an emergency.

One shortcoming with such tools is that a single tool may fall short of providing personnel with the comprehensive equipment capabilities they need. For example, personnel will often realize that they need a different tool after arriving at the scene of an emergency. The personnel will then either have to leave the scene to retrieve additional tools, or have another person bring additional tools to the scene.

Conventionally, some tools may be gathered together into a multi-purpose tool set. One such tool set is known as "the irons." The set of irons includes an axe, a prying tool known as a Halligan bar, and a lock removal device known as a K-tool. These tools are bound together using either a belt, strap, or band of rubber. The tools may be used separately or in combination depending on the task. For example, an end of the Halligan bar can be forced between a door and a doorjamb to pry the two apart. The Halligan bar can also be driven between the door and the doorjamb by striking it with the flat-head axe. The K-tool can be used in conjunction with the Halligan bar and the flat-head axe to remove a cylinder lock. Here, a notch in the K-tool is slipped over the lock cylinder, then forced down by striking it with the flat-head axe. The Halligan bar is then inserted into a flange of the K-tool and used to pry the K-tool off the door, thereby pulling the entire key cylinder out.

Although tool sets are generally thought to be acceptable, they are not without shortcomings. For example, it can be difficult to separate the tools from the set with gloved hands and/or with poor visibility (e.g., dark environments, smoky environments, etc.). Once separated, the individual tools and/or the strap may be lost at the scene. Some tasks may require the concerted efforts of more than one person, each person handling a different tool. Finally, before the set can be moved to a different location, the tools need to be strapped back together again. These shortcomings, among others, may cause personnel to lose valuable time at the scene of an emergency.

SUMMARY

According to a non-limiting embodiment, a whacker tool may include a bar having a first end and a second end. A wedge head may extend from the first end of the bar. A spoon head may extend from the second end of the bar. The spoon head may include a convex working surface and a concave working surface. The convex and the concave working surfaces may face away from each other. A hook may be provided on the bar. A pair of stops may be provided at spaced apart locations on the bar and located between the wedge head and the hook. A slide hammer may be mounted on the bar for movement between the stops.

According to another non-limiting embodiment, a whacker tool may include a bar having a first end and a second end. A first head may extend from the first end of the bar. A second head may extend from the second end of the bar. A hook may be provided on the bar. A pair of stops may be provided at spaced apart locations on the bar and located between the first head and the hook. Means may be mounted on the bar for movement between the pair of stops. The means is for providing impact drive forces on the first head and the second head. The means is also for providing impact pulling forces on the hook.

The above and other features, including various and novel details of construction and combinations of parts will be more particularly described with reference to the accompanying drawings. It will be understood that the details of the example embodiments are shown by way of illustration only and not as limitations of the invention. The principles and features of this invention may be employed in varied and numerous embodiments without departing from the scope of the invention.

BRIEF DESCRIPTION OF THE DRAWINGS

Non-limiting embodiments will become more fully understood from the detailed description below and the accompanying drawings, wherein like elements are represented by like reference numerals, which are given by way of illustration only and thus are not limiting of the present invention.

DESCRIPTION OF NON-LIMITING EMBODIMENTS

This disclosure is directed to a whacker tool that may be used by firefighters inside a building or at the scene of an emergency. It will be appreciated, however, that the whacker tool can be used by other public safety or military personnel in numerous and varied environments.

Figure 1:
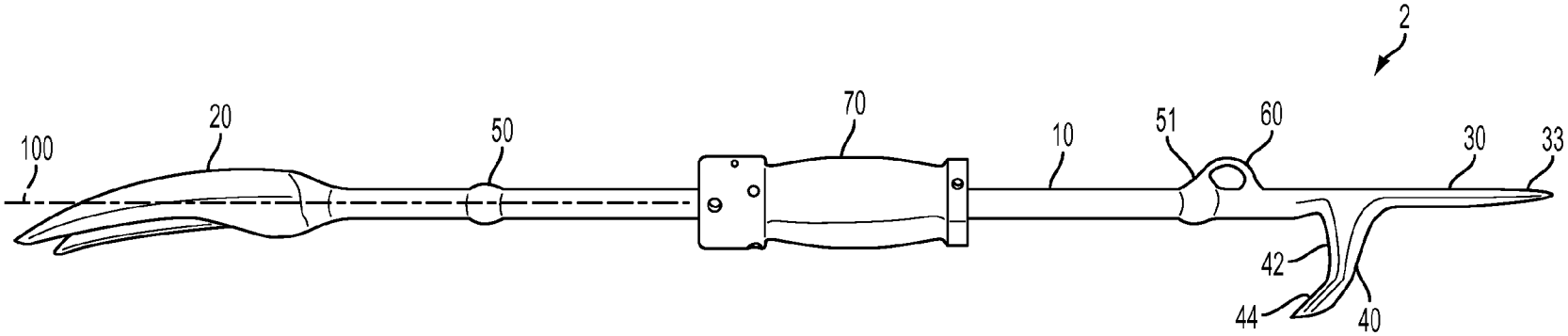
FIG. 1 is a schematic view of a whacker tool according to a non-limiting embodiment.

With reference to FIG. 1, the whacker tool 2 includes an elongated bar 10 that extends along a longitudinal axis 100. One end of the bar 10 is provided with a V-wedge head 20, and the other end of the bar 10 is provided with a spoon head 30 and a J-hook 40. The bar 10 also includes two stops 50, 51 that are spaced apart along the longitudinal axis 100. As shown, the stops 50, 51 are of a greater diameter than the intermediate portion of the bar 10. A carry loop 60 is provided on the bar 10 between the stop 51 and the J-hook 40.

Figure 2:
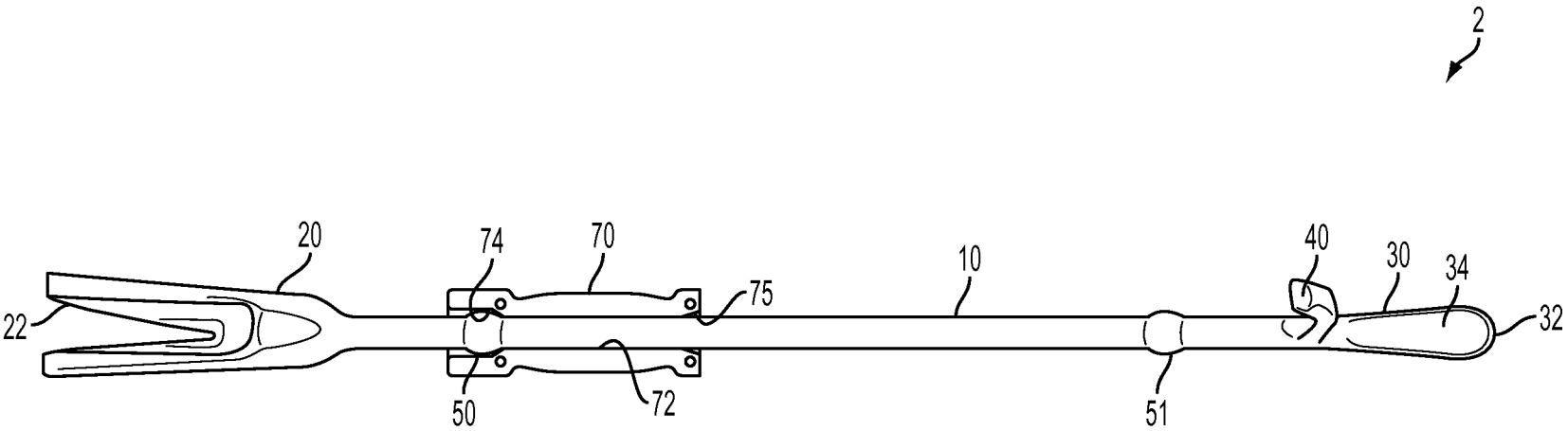
FIG. 2 is another schematic view of the whacker tool depicted in FIG. 1, showing only a portion of the slide hammer.

A slide hammer 70 is slidably mounted on the bar 10. The slide action of the slide hammer 70 is limited by the stops 50, 51. By way of example only, the slide hammer 70 has a generally cylindrical shape, which is intended to be gripped by a user. It will be appreciated, however, that the slide hammer can be of numerous and varied shapes. Turning to FIG. 2, the slide hammer 70 has a central bore 72 that receives the bar 10. The inner diameter of the central bore 72 is greater than the outer diameter of the bar 10, such that the slide hammer 70 can slide back and forth along the bar 10 and between the stops 50, 51. The ends of the central bore 72 are enlarged to provide sockets 74, 75 for respectively receiving the corresponding stops 50, 51. As shown in FIG. 2, the socket 74 receives the stop 50 to limit the movement of the slide hammer 70 toward the V-wedge head 20. In a similar fashion, the other socket 75 can receive the stop 51 to limit the movement of the slide hammer 70 toward the spoon head 30.

As shown in FIG. 2, the socket 74 is extended toward the V-wedge head 20 beyond the stop 50. The extended portion of the socket 74 provides a location for a lock, which will be appreciated with reference to FIG. 3.

Figure 3:
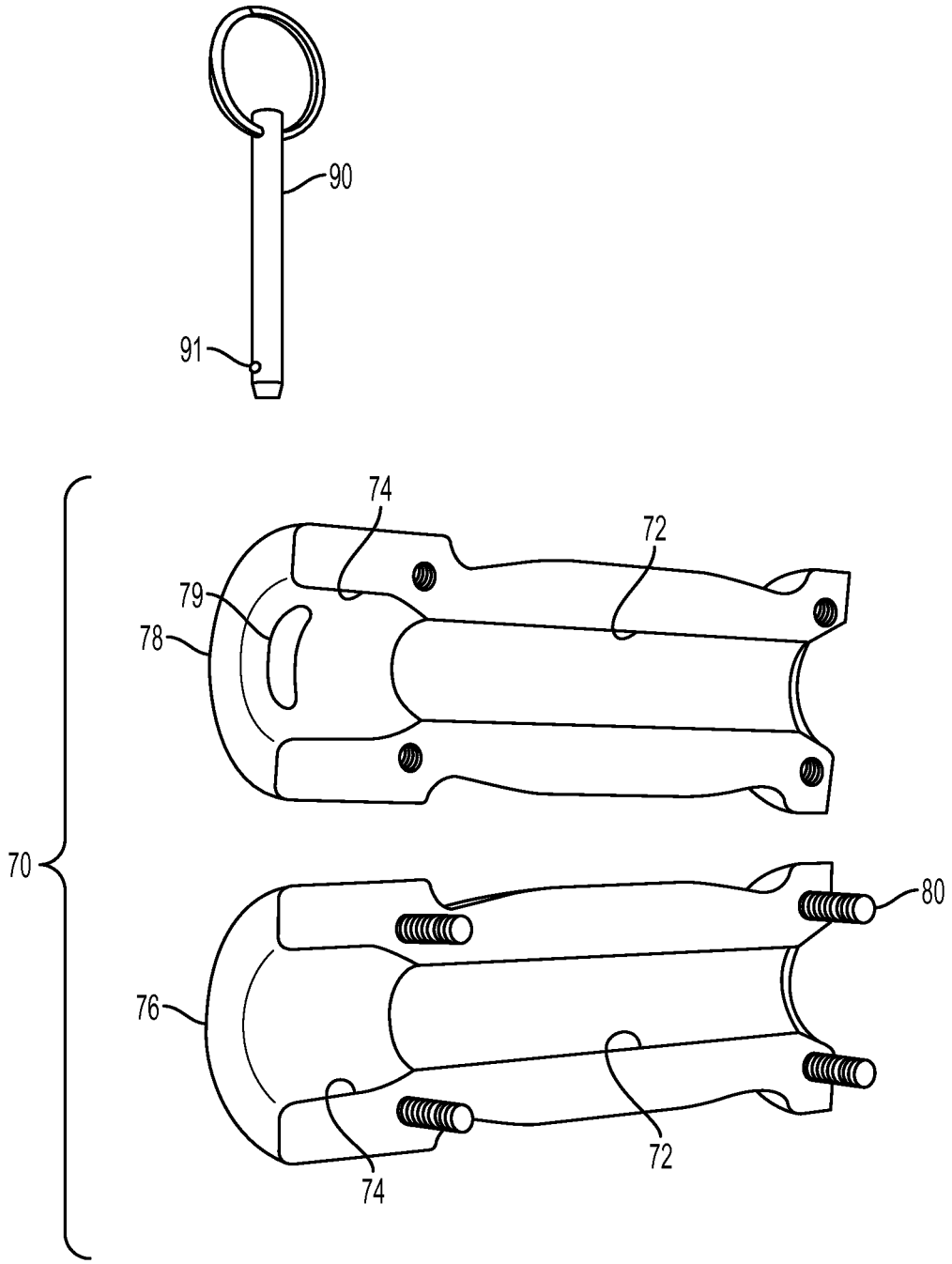
FIG. 3 is an exploded schematic view of the slide hammer depicted in FIG. 1.

As shown in FIG. 3, the slide hammer 70 is of a two piece construction, including two half pieces 76, 78. The two half pieces 76, 78 can be assembled around the bar 10 and secured together using screws 80. The half piece 78 includes a through bore 79 that is perpendicular to the longitudinal axis and offset from the bar 10. The through bore 79 extends all the way through the half piece 78, and passes through the interior of the socket 74. A detent pin 90 can be inserted into the through bore 79 to releasably lock the slide hammer 70 at the longitudinal location depicted in FIG. 2 (i.e., with the socket 74 receiving the stop 50). Here, the detent pin 90 extends through the interior of the socket 74, and passes on the outside of the bar 10 and on the far side of the stop 50. The detent pin 90 does not pass through the bar 10, which increases the strength of the bar 10. In this way, the detent pin 90 retains the stop 50 in the socket 74. As is well known in this art, the detent pin 90 includes a spring loaded bearing 91 that will seat on a shoulder (not shown) provided in the through bore 79 to secure the pin 90 in position.

Figure 4:
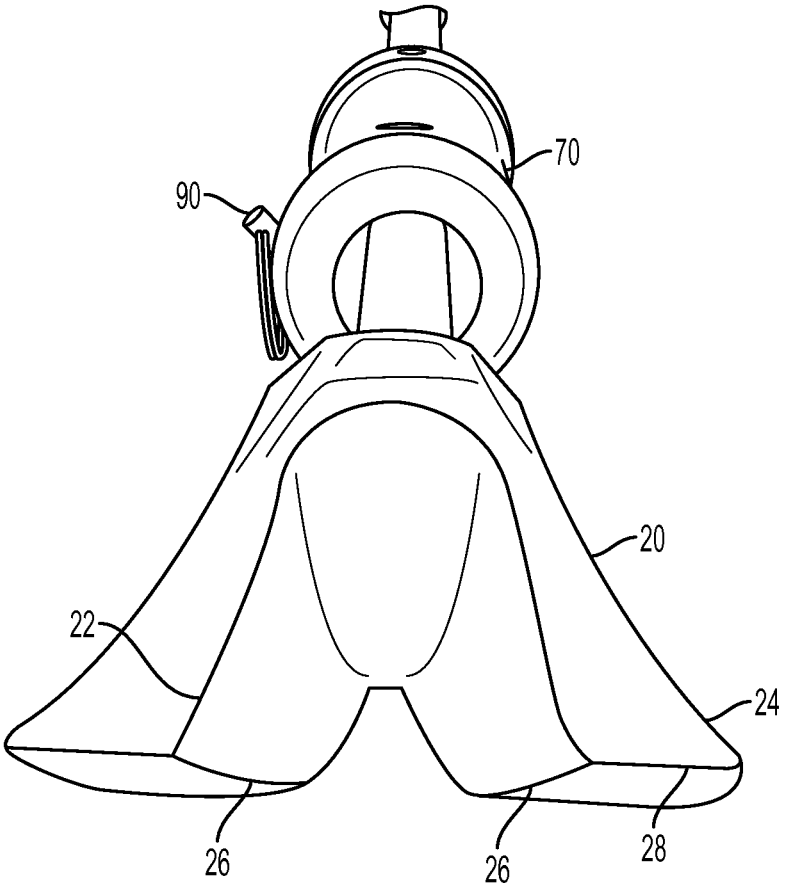
FIG. 4 is an enlarged partial view of the V-wedge head depicted in FIG. 1.

The V-wedge head 20 has a tapered shape that gradually curves to form an obtuse angle with respect to the longitudinal axis 100. As shown in FIG. 4, the V-wedge head 20 is bifurcated by a centrally located V-shaped notch 22 into two legs 24. The distal ends 28 of the two legs 24 are spaced apart a distance sufficient to receive a doorknob or cylinder lock. By way of example only, the distal ends 28 may be spaced apart by more than 1.5 inches. Each leg 24 has in inward facing sharp edge 26 that extends from the distal end 28 of the leg 24. Also, each leg 24 has a flattened face (i.e., the bottom face in FIG. 4) extending from the distal end 28 along the length of the sharp edge 26.

As shown in FIG. 1, the spoon head 30 extends generally parallel to the longitudinal axis 100. The spoon head 30 has contoured working surfaces like a spoon. One working surface 33 is convex (see FIG. 1), while the opposite working surface 34 is concave (see FIG. 2). The working surfaces 33, 34 form a shallow bowl that is longer and wider than it is deep. The outer contour 32 of the spoon head 30 is rounded, and without any sharp edge. The concave working surface 34 faces toward the J-hook 40.

As shown in FIG. 1, the J-hook 40 is positioned at the base of the spoon head 30. The J-hook 40 has a relatively thick base 42 that extends at a right angle with respect to the longitudinal axis 100, and a relatively thin leg 44 that extends from the base 42 and back toward the slide hammer 70. The J-hook 40 lies in a plane that is generally perpendicular to the working surfaces 33, 34 of the spoon head 30.

The use of the whacker tool 2 is straightforward. Straps or carabineer style hooks may be attached to the carry loop 60 for convenient transport by public safety or military personnel. During transport, the slide hammer 70 is locked to the stop 50 using the detent pin 90. Accordingly, the whacker tool 2 can be transported in a vertical orientation with the slide hammer 70 located near the bottom of the bar 10.

Once the personnel arrives on the scene, the whacker tool 2 is removed from the strap (or hook) and ready for use. Personnel often encounter a variety of valves (e.g., natural gas and water service valves) having different valve heads of different shapes and sizes. The V-wedge head 20 can be used to manipulate such valves. Here, the V-shaped notch 22 is pushed down over the valve head until the legs 24 seat on the valve head. The person can then grasp the bar 10 and/or J-hook to turn the tool 2, thereby turning the valve head in the desired direction.

The whacker tool 2 can be used to breach inward and outward opening doors, windows, and locks. For example, as an initial breaching operation, the spoon head 30 can be forced between a door and a doorjamb to pry the two apart. Here, the rounded, outer contour 32 of the spoon head 30, which is blunt, decreases the chance of cutting into the doorjamb. This also makes the spoon head 30 more durable, stronger, and safer to handle (as compared to heads with sharp edges). Further, the contoured working surfaces 33, 34 experience less friction during insertion as compared to conventional wedge elements having planar working surfaces. This is because only the outer portion of the concave working surface 34 and only the central portion of the convex working surface 33 may contact and push apart the door and the doorjamb.

If additional force is needed to insert the spoon head 30, the detent pin 90 can be removed to utilize the slide hammer 70. Here, and with reference to FIG. 5, the person would grasp the V-head wedge 20 with one hand, and the slide hammer 70 with the other hand. The person could then repeatedly pound the slide hammer 70 against the stop 51, imparting impact drive forces on the spoon head 30 and forcing it between the door and the doorjamb.

Figure 5:
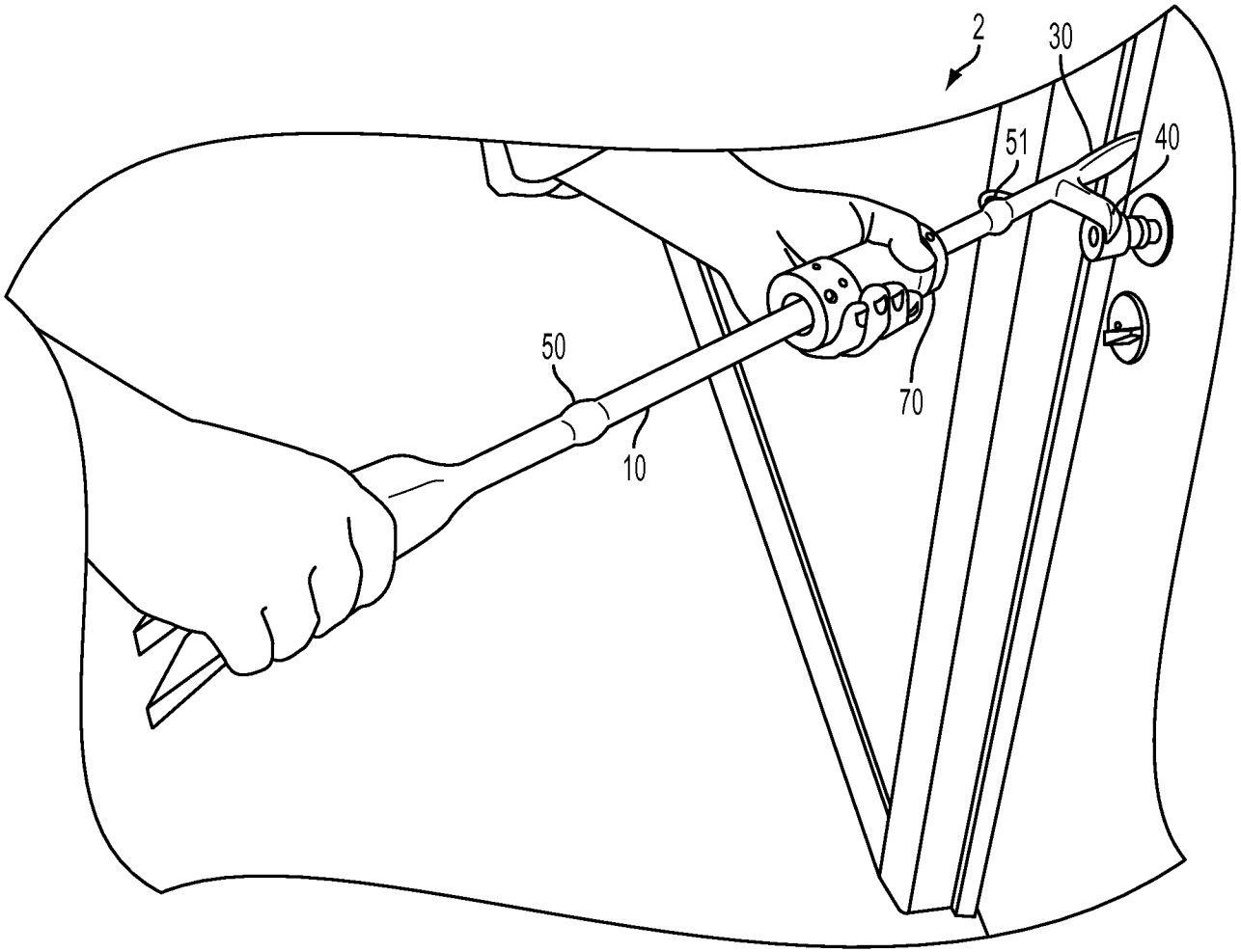
FIG. 5 is a schematic view of the whacker tool in use.

Once the spoon head 30 is inserted, the person can then manipulate the bar 10 to breach the door. At this time, the J-hook 40 can be placed against the door (if inward opening as shown in FIG. 5) or the doorjamb (if the door is outward opening) to provide additional leverage for defeating the door and locks. That is, the J-hook 40 can be used as a fulcrum to provide mechanical advantage in the prying operation.

The V-wedge head 20 can be used in a similar fashion as the spoon head 30 in door breaching operations, and with or without utilizing the slid hammer 70. However, it is preferable to use the spoon head 30 as the initial breaching operation primarily because it is thinner (and offers less resistance) than the V-wedge head 20.

The V-wedge head 20 can also be used as a sheet metal cutter to cut, for example, the roof or door panels of an automobile. Here, the V-shaped notch 22 is placed on the sheet metal. The bar 10 is then manipulated back and forth so that the sharp edges 26 of the legs 24 cut through the sheet metal.

Figure 6:
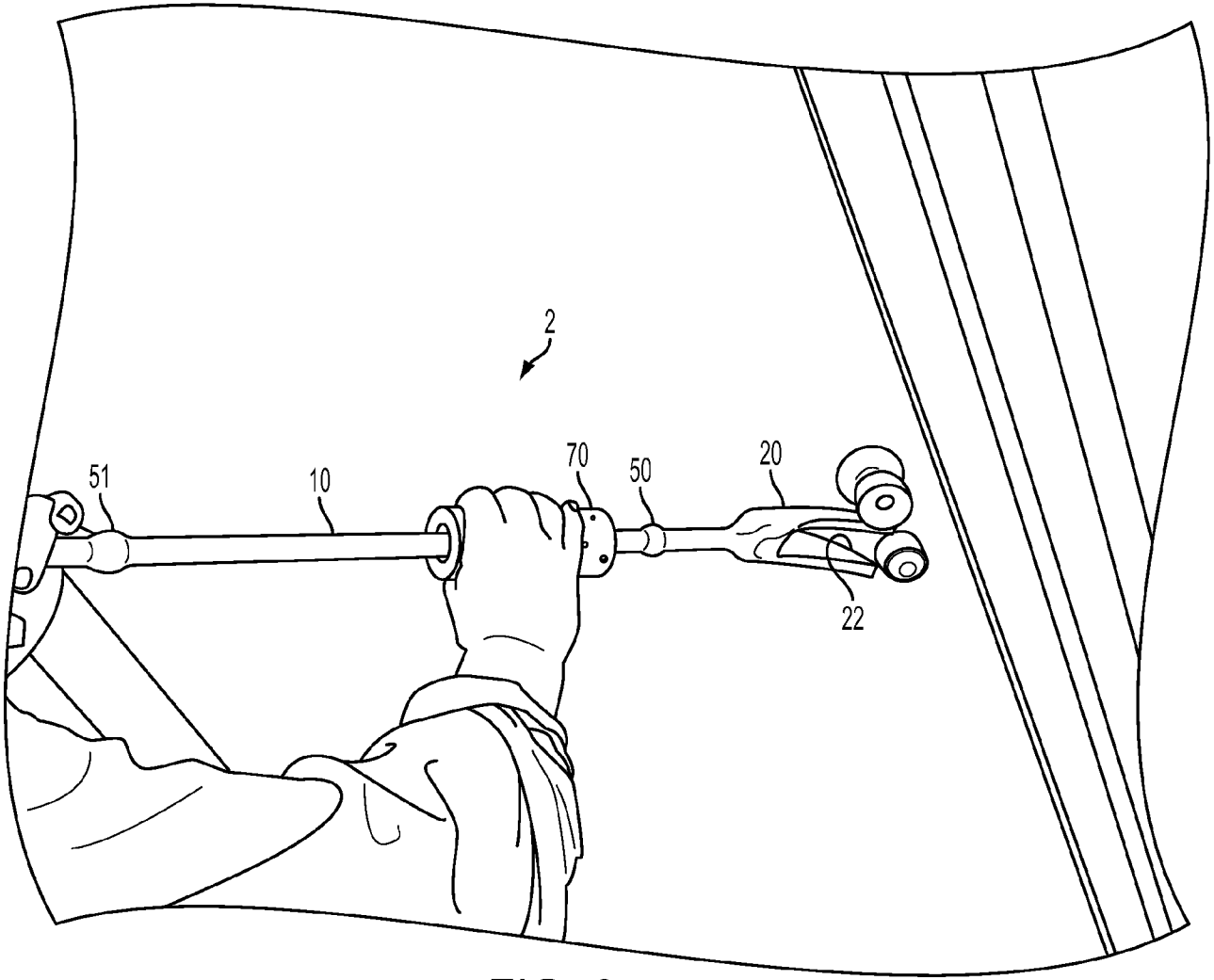
FIG. 6 is another schematic view of the whacker tool in use.

The V-wedge head 20 can also be used to remove cylinder locks and door knobs. For example, the V-shaped notch 22 can be slipped over the lock cylinder, as shown in FIG. 6. With the detent pin 90 removed, the person would grasp the spoon head 30 and/or the J-hook 40 with one hand, and the slide hammer 70 with the other hand. The person then repeatedly pounds the slide hammer 70 against the stop 50, imparting impact drive forces on the V-wedge head 20 forcing it between the door and the cylinder lock. The bar 10 is then manipulated to pry the entire key cylinder out.

As noted above, the J-hook 40 may serve as a fulcrum during door breaching and other prying operations. The J-hook 40 provides additional functionality. For example, the J-hook 40 may be used to quickly remove drywall and plaster ceilings and walls. Here, the spoon head 30 can be punched through the ceiling or wall to create a hole large enough for the J-hook 40. The person can then repeatedly position the J-hook 40 behind adjacent portions of the ceiling or wall and pull on the bar 10 to remove portions of the ceiling or wall.

If additional force is needed to remove portions of the ceiling or wall (e.g., laths, studwork, etc.), the detent pin 90 can be removed to utilize the slide hammer 70. Here, the person would grasp the V-head wedge 20 with one hand, and the slide hammer 70 with the other hand. The person could then repeatedly pound the slide hammer 70 against the stop 50, imparting impact pulling forces on the J-hook 40 and ripping it through portions of the ceiling or the wall.

As discussed above, the slide hammer 70 (as impact means) can be pounded against the stop 50 to provide impact drive forces on the V-wedge head 20 and impact pulling forces on the J-hook 40. The slide hammer can also be pounded against the stop 51 to provide impact drive forces on the spoon head 30. Thus, the slide hammer 70 provides impact drive forces for features on both ends of the whacker tool 2, and impact pulling forces for features on at least one end of the whacker tool 2.

In the illustrated embodiment, the bar 10, the V-wedge head 20, the spoon head 30, the J-hook 40, and the stops 50-51, may be of a unitary one-piece construction of tempered steel. The invention is not, however, limited in this regard. For example, the various components can be provided as separate parts and welded together. The components can also be fabricated from numerous and varied materials (other than tempered steel) that are well known in this art.

In the illustrated embodiment, the slide hammer 70 is of a two-piece construction of tempered steel. The invention is not, however, limited in this regard. For example, the slide hammer 70 may include more or less than 2 pieces. The slide hammer 70 can also be fabricated from numerous and varied materials (other than tempered steel) that are well known in this art.

In the illustrated embodiment, the bar 10 has a circular cross-sectional shape corresponding to the circular cross-sectional shape of the central bore 72 in the slide hammer 70. Thus, the slide hammer 70 is rotatable about the bar 10. In alternative embodiments, however, the bar 10 and the central bore 72 may have alternative corresponding cross-sectional shapes (e.g., including one or more flats) that would prevent relative rotation between the slide hammer 70 and the bar 10.

In the illustrated embodiment, the stops 50, 51 have a ball shape that corresponds to the partial ball shape of the bottoms of the sockets 74, 75. It will be appreciated, however, that stops and sockets having alternative corresponding shapes may be suitably implemented.

By way of example only, the whacker tool may have a total weight of 11 lbs., and total length of 37 inches, and the slide hammer may weigh 4 lbs. The invention is not, however, limited in this regard.

Although the foregoing description is directed to the preferred embodiments of the present teachings, it is noted that other variations and modifications will be apparent to those skilled in the art, and which may be made without departing from the spirit or scope of the present teachings.

The foregoing detailed description of the various embodiments of the present teachings has been provided for the purposes of illustration and description. It is not intended to be exhaustive or to limit the present teachings to the precise embodiments disclosed. Many modifications and variations will be apparent to practitioners skilled in this art. The embodiments were chosen and described in order to explain the principles of the present teachings and their practical application, thereby enabling others skilled in the art to understand the present teachings for various embodiments and with various modifications as are suited to the particular use contemplated. It is intended that the scope of the present teachings be defined by the following claims and their equivalents.

What is claimed is:

1. A whacker tool comprising:
- a bar having a first end and a second end;
- a wedge head extending from the first end of the bar;
- a spoon head extending from the second end of the bar, the spoon head including a convex working surface and a concave working surface, the convex and the concave working surfaces facing away from each other;
- a hook provided on the bar;
- a pair of stops provided at spaced apart locations on the bar and located between the wedge head and the hook; and
- a slide hammer mounted on the bar for movement between the stops.

2. The whacker tool according to claim 1, wherein the hook is a J-hook.

3. The whacker tool according to claim 2, wherein the J-hook is positioned at a base of the spoon head.

4. The whacker tool according to claim 3, wherein the J-hook has a base that extends at a right angle with respect to the bar, and a leg that extends from the base and toward the slide hammer.

5. The whacker tool according to claim 4 wherein the J-hook lies in a plane that is perpendicular to the working surfaces of the spoon head.

6. The whacker tool according to claim 1, wherein the wedge head has a tapered V-shape that curves to form an obtuse angle with the bar.

7. The whacker tool according to claim 1, wherein the wedge head includes a V-shaped notch that bifurcates the wedge head into two legs, each leg having an inward facing sharp edge and a flat bottom surface extending from the sharp edge.

8. The whacker tool according to claim 1, wherein the slide hammer includes a through bore that is perpendicular to the bar; and
- wherein a detent pin is removably inserted into the through bore such that one of the stops is retained between the detent pin and the slide hammer.

9. The whacker tool according to claim 1, wherein the bar, the wedge head, the spoon head, the hook, and the stops are of a unitary, one-piece construction of metal.

10. A whacker tool comprising:
- a bar having a first end and a second end;
- a first head extending from the first end of the bar;
- a second head extending from the second end of the bar;
- a hook provided on the bar;
- a pair of stops provided at spaced apart locations on the bar and located between the first head and the hook; and
- means mounted on the bar for movement between the pair of stops, the means for
  - providing impact drive forces on the first head and the second head, and
  - providing impact pulling forces on the hook;
- wherein the bar, the first head. the second head, the hook. and the stops are of a unitary, one-piece construction of metal.

11. The whacker tool according to claim 10, wherein the pair of stops includes a first stop located toward the first head, and a second stop located toward the hook; and
- wherein the means is for
  - pounding against the first stop to provide impact drive forces on the first head,
  - pounding against the first stop to provide impact pulling forces on the hook, and pounding against the second stop to provide impact drive forces on the second head.

12. The whacker tool according to claim 10, wherein the hook is a J-hook.

13. A whacker tool comprising:

a bar having a first end and a second end;

a first head extending from the first end of the bar;

a second head extending from the second end of the bar;

a hook provided on the bar;

a pair of stops provided at spaced apart locations on the bar and located between the first head and the hook; and means mounted on the bar for movement between the pair of stops, the means for providing impact drive forces on the first head and the second head, and providing impact pulling forces on the hook;

wherein the first head is a wedge head having a tapered V-shape that curves to form an obtuse angle with the bar.

14. The whacker tool according to claim 13, wherein the wedge head includes a V-shaped notch that bifurcates the wedge head into two legs, each leg having an inward facing sharp edge and a flat bottom surface extending from the sharp edge.

15. A whacker tool comprising:

a bar having a first end and a second end;

a first head extending from the first end of the bar;

a second head extending from the second end of the bar;

a hook provided on the bar;

a pair of stops provided at spaced apart locations on the bar and located between the first head and the hook; and means mounted on the bar for movement between the pair of stops, the means for providing impact drive forces on the first head and the second head, and providing impact pulling forces on the hook;

wherein the second head is a spoon head including a convex working surface and a concave working surface, the convex and the concave working surfaces facing away from each other.

16. A whacker tool comprising:

a bar having a first end and a second end;

a first head extending from the first end of the bar;

a second head extending from the second end of the bar;

a hook provided on the bar;

a pair of stops provided at spaced apart locations on the bar and located between the first head and the hook; and means mounted on the bar for movement between the pair of stops, the means for providing impact drive forces on the first head and the second head, and providing impact pulling forces on the hook;

wherein the means is a slide hammer, the slide hammer including a through bore that is perpendicular to the bar; and wherein a detent pin is removably inserted into the through bore such that one of the stops is retained between the detent pin and the slide hammer.

* * * * *